US009945212B2

(12) United States Patent
Sanders

(10) Patent No.: US 9,945,212 B2
(45) Date of Patent: Apr. 17, 2018

(54) EXPANDABLE WELL SCREENS WITH SLURRY DELIVERY SHUNT CONDUITS

(71) Applicant: HALLIBURTON ENERGY SERVICES, INC., Houston, TX (US)

(72) Inventor: Michael W. Sanders, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 377 days.

(21) Appl. No.: 14/435,663

(22) PCT Filed: Jan. 20, 2013

(86) PCT No.: PCT/US2013/022334
§ 371 (c)(1),
(2) Date: Apr. 14, 2015

(87) PCT Pub. No.: WO2014/113029
PCT Pub. Date: Jul. 24, 2014

(65) Prior Publication Data

US 2015/0285039 A1 Oct. 8, 2015

(51) Int. Cl.
*E21B 43/10* (2006.01)
*E21B 43/08* (2006.01)
(Continued)

(52) U.S. Cl.
CPC ..... *E21B 43/08* (2013.01); *E21B 33/1277* (2013.01); *E21B 33/138* (2013.01);
(Continued)

(58) Field of Classification Search
CPC .... E21B 33/138; E21B 33/1277; E21B 43/04; E21B 43/08–43/108
See application file for complete search history.

(56) References Cited

U.S. PATENT DOCUMENTS 6,848,510 B2 2/2005 Bixenman et al.
7,373,989 B2 5/2008 Setterberg, Jr.
(Continued)

OTHER PUBLICATIONS

International Search Report and Written Opinion dated Oct. 4, 2013 for PCT Application No. PCT/US13/22334, 17 pages.
(Continued)

*Primary Examiner* — George S Gray
(74) *Attorney, Agent, or Firm* — Locke Lord LLP; Joshua L. Jones; Joseph A. Farco

(57) ABSTRACT

A well screen can include multiple filter section ends, the filter section ends being displaced outward in response to expansion of the well screen, and a slurry delivery shunt conduit positioned circumferentially between the filter section ends. A method of delivering a slurry into a wellbore about a well screen can include positioning slurry delivery shunt conduits between multiple circumferentially spaced apart filter sections of the well screen, the filter sections radially outwardly displacing in a well, and flowing the slurry through the shunt conduits. A well system can include multiple well screens positioned in a wellbore, and shunt conduits which deliver a slurry into the wellbore about the well screens, the shunt conduits being positioned circumferentially between filter sections of the well screens.

19 Claims, 3 Drawing Sheets

(51) Int. Cl.
*E21B 33/127* (2006.01)
*E21B 43/04* (2006.01)
*E21B 33/138* (2006.01)

(52) U.S. Cl.
CPC ..... *E21B 43/04* (2013.01); *E21B 43/103* (2013.01); *E21B 43/108* (2013.01)

(56) References Cited

U.S. PATENT DOCUMENTS

| | | | | |
|---|---|---|---|---|
| 8,127,831 | B2 | 3/2012 | Haeberle et al. | |
| 2002/0092649 | A1* | 7/2002 | Bixenman | E21B 43/04 166/278 |
| 2002/0189809 | A1* | 12/2002 | Nguyen | E21B 43/045 166/278 |
| 2004/0104026 | A1* | 6/2004 | Johnson | E21B 43/08 166/207 |
| 2006/0237197 | A1* | 10/2006 | Dale | E21B 43/04 166/378 |
| 2011/0036565 | A1* | 2/2011 | Holderman | E21B 43/103 166/227 |
| 2011/0067863 | A1* | 3/2011 | Peixoto | E21B 17/1014 166/278 |
| 2012/0199342 | A1 | 8/2012 | Yeh et al. | |
| 2012/0234555 | A1 | 9/2012 | Dale et al. | |

OTHER PUBLICATIONS

Halliburton, "PetroGuard® Swell Screen", H07653, dated Jan. 2012, 2 pages.

* cited by examiner

EXPANDABLE WELL SCREENS WITH SLURRY DELIVERY SHUNT CONDUITS

TECHNICAL FIELD

This disclosure relates generally to equipment utilized and operations performed in conjunction with a subterranean well and, in one example described below, more particularly provides an expandable well screen with slurry delivery shunt conduits.

BACKGROUND

Shunt tubes are used typically to flow slurries about completion strings in wells. Shunt tubes are beneficial, in that they promote more even distribution of the slurries about the completion strings. It will be appreciated that advancements are continually needed in the art of constructing and operating completion assemblies with shunt tubes.

DETAILED DESCRIPTION

Figure 1:
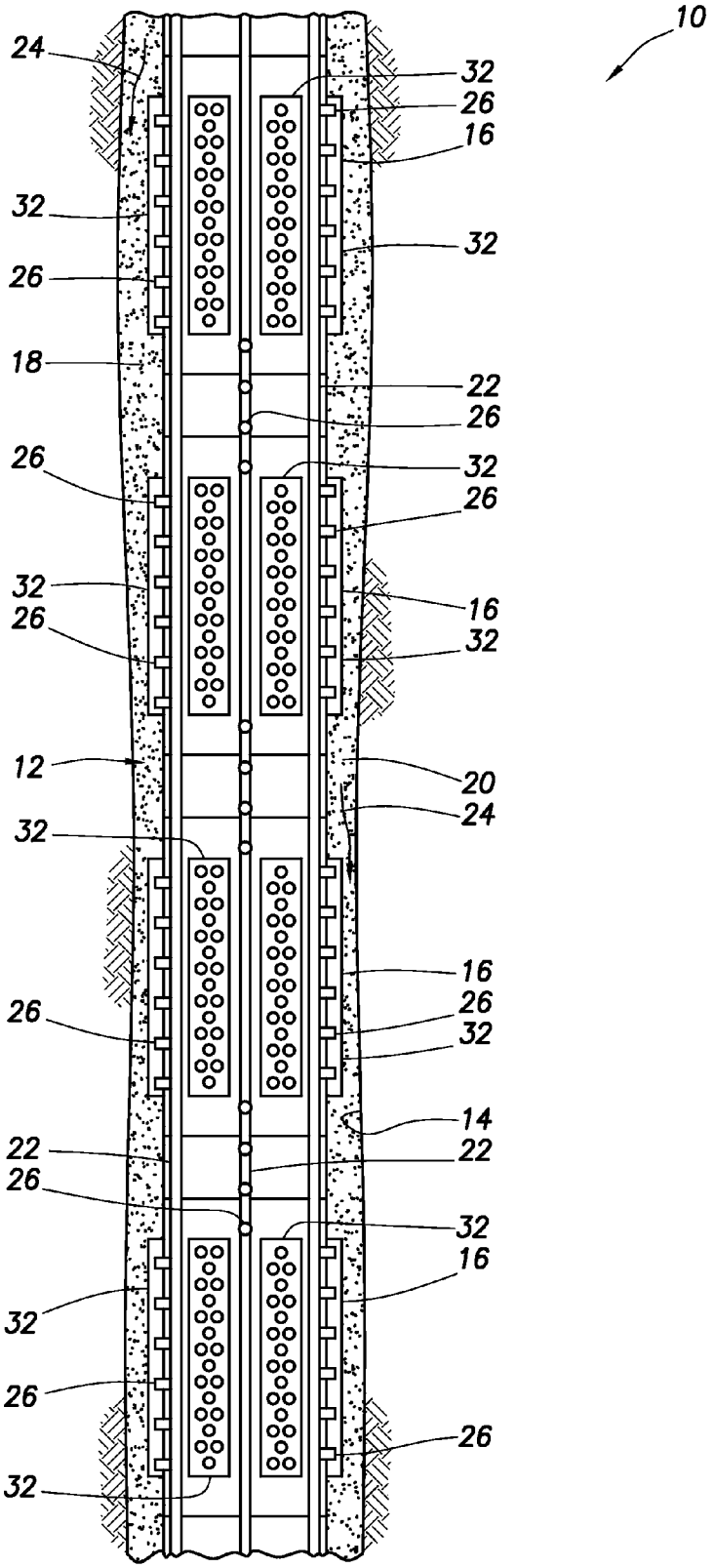
FIG. 1 is a representative partially cross-sectional view of a well system and associated method which can embody principles of this disclosure.

Representatively illustrated in FIG. 1 is a system 10 for use with a subterranean well, and an associated method, which system and method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a generally tubular string 12 (such as, a completion string, gravel packing string, stimulation string, etc.) is positioned in a wellbore 14. The tubular string 12 includes well screens 16 for filtering fluid which flows from the wellbore 14 into an interior of the tubular string.

It is desired in the FIG. 1 system 10 and method to deposit gravel 18 or other particulate matter (whether natural or synthetic) into an annulus 20 formed radially between the tubular string 12 and the wellbore 14. The gravel 18 is preferably packed uniformly about the well screens 16.

Shunt conduits 22 provide an alternate path for flow of a slurry 24 comprising the gravel (e.g., sand, proppant) 18 and a liquid carrier (such as, water, brine, acid, a treatment fluid, fracturing fluid, etc.). A substantial portion of the slurry 24 flows through the annulus 24, but the shunt conduits 22 allow the slurry to flow into the annulus to fill in voids or less dense areas of the gravel 18 pack, so that the gravel is packed uniformly about the tubular string 12. The shunt conduits 22 can include nozzles 26 to direct the slurry 24 outward from the shunt conduits.

In fracturing operations, the slurry 24 could comprise a proppant and a liquid carrier. The scope of this disclosure is not limited to any particular type of slurry 24.

Figure 2:
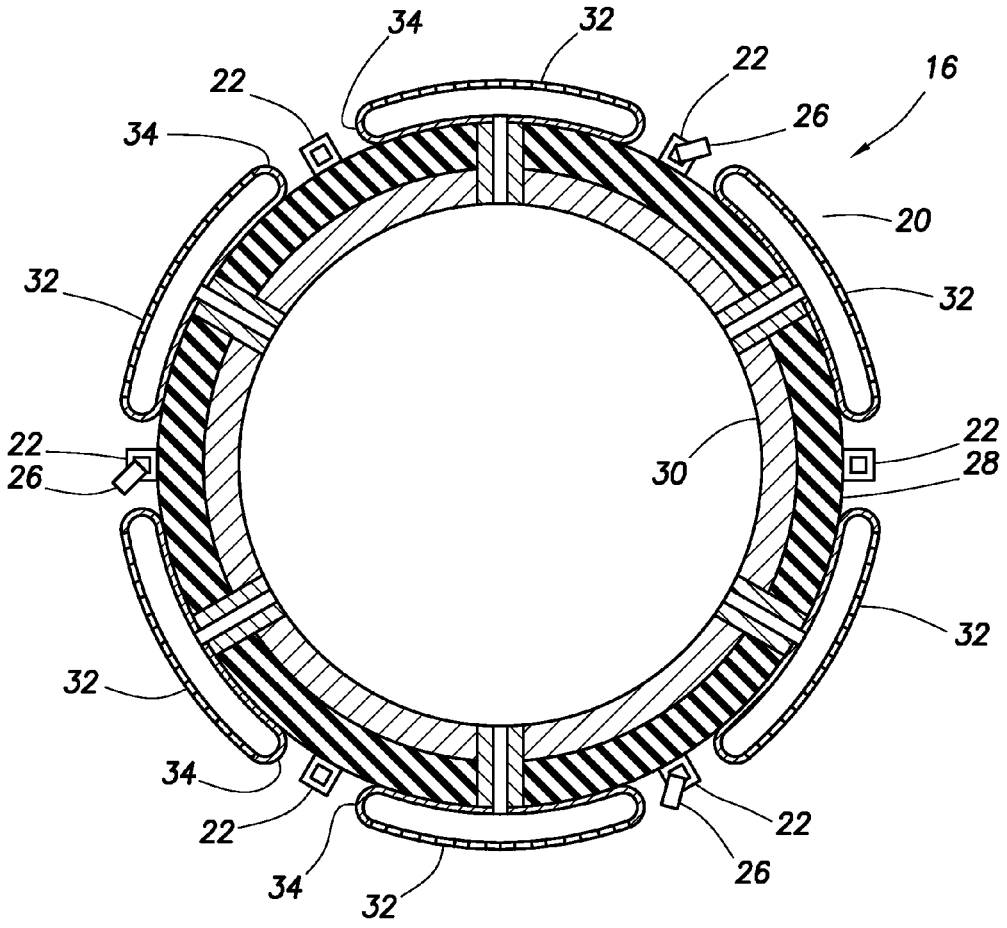
FIG. 2 is a representative cross-sectional view of a well screen which can embody the principles of this disclosure, and which may be used in the system and method of FIG. 1.

Referring additionally now to FIG. 2, a cross-sectional view of one example of a well screen 16 is representatively illustrated. In this example, the well screen 16 includes a swellable material 28 overlying a base pipe 30.

The base pipe 30 is configured for connection in the tubular string 12 if used in the system 10 and method of FIG. 1. However, the well screen 16 of FIG. 2 can also be used in other systems and methods.

External to the swellable material 28 are longitudinally extending and circumferentially spaced apart filter sections 32. The filter sections 32 filter fluid which flows between an interior and an exterior of the well screen 16. In the FIG. 1 example, the filter sections 32 filter fluid which flows from the annulus 20 to the interior of the tubular string 12.

Preferably, the swellable material 28 swells when it is contacted with a particular activating agent (e.g., oil, gas, other hydrocarbons, water, acid, other chemicals, etc.) in the well. The activating agent may already be present in the well, or it may be introduced after installation of the well screen 16 in the well, or it may be carried into the well with the screen, etc. The swellable material 28 could instead swell in response to exposure to a particular temperature, or upon passage of a period of time, or in response to another stimulus, etc.

Thus, it will be appreciated that a wide variety of different ways of swelling the swellable material 28 exist and are known to those skilled in the art. Accordingly, the scope of this disclosure is not limited to any particular manner of swelling the swellable material 28. Furthermore, the scope of this disclosure is also not limited to any of the details of the well system 10 and method described herein, since the principles of this disclosure can be applied to many different circumstances.

The term "swell" and similar terms (such as "swellable") are used herein to indicate an increase in volume of a swellable material. Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 28 is in this example preferably a hydrocarbon fluid (such as oil or gas). In the well system 10, the swellable material 28 swells when a fluid comprises the activating agent (e.g., when the fluid enters the wellbore 14 from a formation surrounding the wellbore, when the fluid is circulated to the screen from the surface, when the fluid is released from a chamber carried with the screen, etc.).

The activating agent which causes swelling of the swellable material 28 could be comprised in any type of fluid. The activating agent could be naturally present in the well, or it could be conveyed with the screen 16, conveyed separately or flowed into contact with the swellable material 28 in the well when desired. Any manner of contacting the activating agent with the swellable material 28 may be used in keeping with the principles of this disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367, 7,059,415 and 7,143,832, the entire disclosures of which are incorporated herein by this reference.

As another alternative, the swellable material 28 may have a substantial portion of cavities therein which are compressed or collapsed at the surface condition. Then, after being placed in the well at a higher pressure, the material 28 is expanded by the cavities filling with fluid.

This type of apparatus and method might be used where it is desired to expand the swellable material 28 in the presence of gas rather than oil or water. A suitable swellable material is described in U.S. Published Application No. 2007-0257405, the entire disclosure of which is incorporated herein by this reference.

Preferably, the swellable material 28 used in the well screen 16 swells by diffusion of hydrocarbons into the swellable material, or in the case of a water swellable material, by the water being absorbed by a super-absorbent material (such as cellulose, clay, etc.) and/or through osmotic activity with a salt-like material. Hydrocarbon-, water- and gas-swellable materials may be combined, if desired.

It should, thus, be clearly understood that any swellable material which swells when contacted by a predetermined activating agent may be used in keeping with the principles of this disclosure. The swellable material 28 could also swell in response to contact with any of multiple activating agents. For example, the swellable material 28 could swell when contacted by hydrocarbon fluid, or when contacted by water.

The shunt conduits 22 may be in the form of tubes positioned circumferentially between oppositely facing circumferential ends 34 of the filter sections 32. In other examples, the shunt conduits 22 may not be tubular in shape, for example, conforming complementarily to the shapes of the filter section ends 34.

Figure 3:
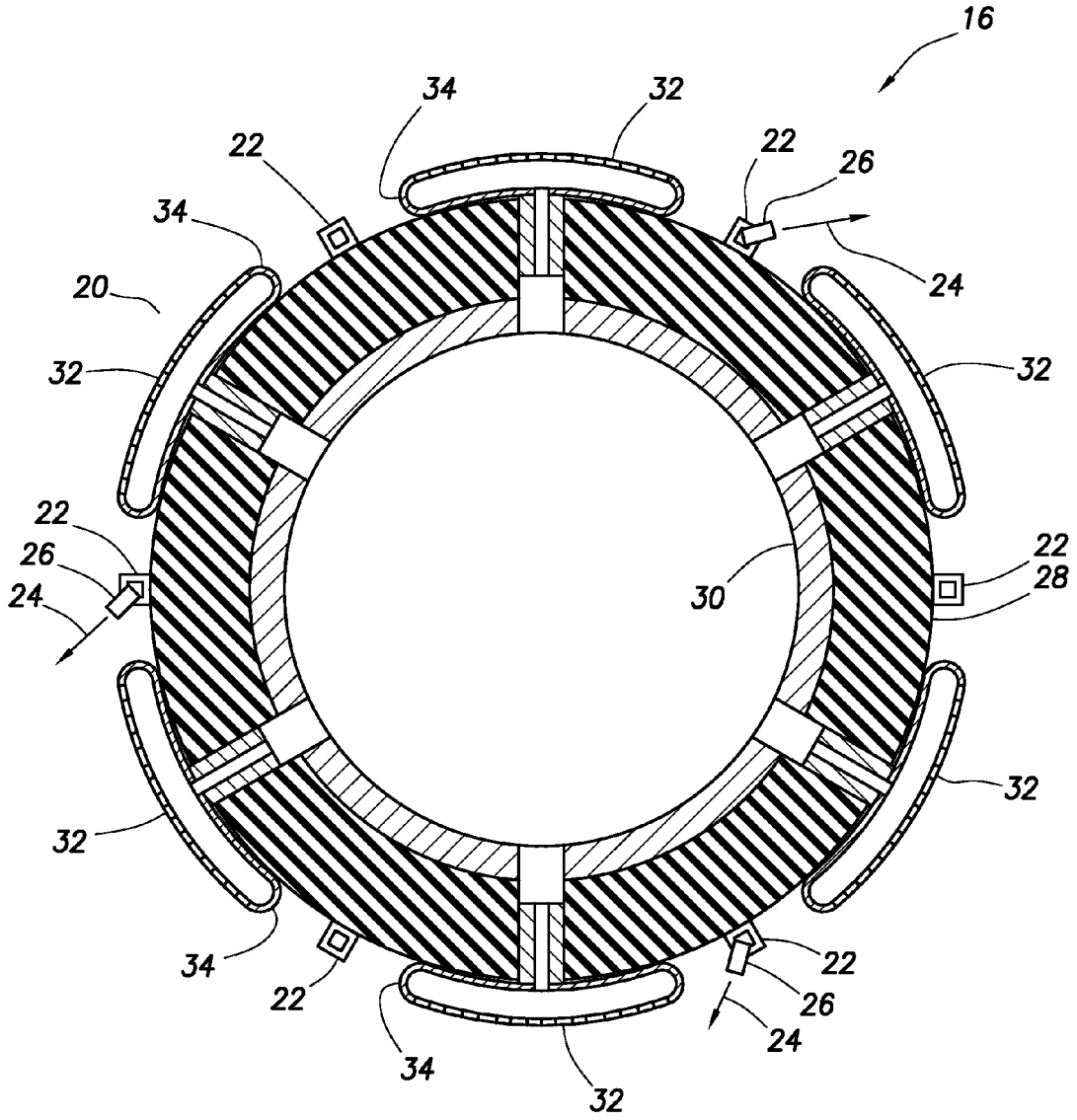
FIG. 3 is a representative cross-sectional view of the well screen after expansion in a wellbore.

Referring additionally now to FIG. 3, the well screen 16 is representatively illustrated after the swellable material 28 has swollen. Note that the filter sections 32 and the shunt conduits 22 are displaced outward by the swelling of the material 28.

Preferably, the slurry 24 is flowed through the shunt conduits 22 after the swellable material 28 has swollen. The slurry 24 could be flowed through the shunt conduits 22 before or after the swellable material 28 has swollen, in other examples. The slurry 24 is discharged from the shunt conduits 22 into the annulus 20 via the nozzles 26.

After the swellable material 28 has swollen, the shunt conduits 22 are a relatively incompressible structure, which would act to further compress, or act to increase the density and decrease the porosity of the particulate matter in the annulus 20, thus making it a more efficient filter for formation sand.

It may now be fully appreciated that the above disclosure provides significant advancements to the art of shunt conduit design and operation. In examples described above, the shunt conduits 22 can be conveniently positioned between the filter sections 32 prior to the swellable material 28 swelling, and can be used to discharge the slurry 24 into the annulus 20 when desired.

A well screen 16 is provided to the art by the above disclosure. In one example, the well screen 16 can include multiple filter section ends 34, the filter section ends 34 being displaced outward in response to expansion of the well screen 16, and a slurry delivery shunt conduit 22 positioned circumferentially between the filter section ends 34.

The multiple filter section ends 34 may be included in one or more filter sections 32 that are displaced outward in response to the expansion of the well screen 16.

The filter sections 32 can be displaced outward by a material 28 which swells in response to contact with a fluid in a well.

The well screen 16 may expand in response to contact between a swellable material 28 and a fluid in a well.

The shunt conduit 22 may displace outward in response to the expansion of the well screen 16.

The slurry 24 may flow outward from the shunt conduit 22 via a nozzle 26 connected to the shunt conduit.

A method of delivering a slurry 24 into a wellbore 14 about a well screen 16 is also described above. In one example, the method can comprise: positioning slurry delivery shunt conduits 22 between multiple circumferentially spaced apart filter sections 32 of the well screen 16; the filter sections 32 radially outwardly displacing in a well; and flowing the slurry 24 through the shunt conduits 22.

The outwardly displacing step can include a material 28 swelling in response to contact with a fluid in the well.

The outwardly displacing step can include the shunt conduits 22 outwardly displacing with the filter sections 32.

The flowing step can include flowing the slurry 24 outward from the shunt conduits 22 between the filter sections 32. The flowing step can include flowing the slurry 24 outward from the shunt conduits 22 via nozzles 26 connected to the shunt conduits 22.

The shunt conduits 22 may be positioned circumferentially between the filter sections 32.

A well system 10 described above can include: multiple well screens 16 positioned in a wellbore 14; and shunt conduits 22 which deliver a slurry 24 into the wellbore 14 about the well screens 16, the shunt conduits 22 being positioned circumferentially between filter sections 32 of the well screens 16.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well screen, comprising:

a base pipe configured for connection in a tubular string defining a longitudinal axis;

a swellable material overlying the base pipe;

multiple filter section ends external to the swellable material, the filter section ends being displaced outward in response to expansion of the swellable material; and a slurry delivery shunt conduit positioned external to the swellable material and circumferentially between the filter section ends prior to the expansion.

2. The well screen of claim 1, wherein the multiple filter section ends are included in at least one filter section that is displaced outward in response to the expansion of the well screen.

3. The well screen of claim 1, wherein the multiple filter section ends are included in multiple respective filter sections that are displaced radially outward in response to the expansion of the well screen.

4. The well screen of claim 3, wherein the filter sections are displaced outward by the swellable material which swells in response to contact with a fluid in a well.

5. The well screen of claim 1, wherein the well screen expands in response to contact between the swellable material and a fluid in a well.

6. The well screen of claim 1, wherein the shunt conduit displaces outward in response to the expansion of the well screen.

7. The well screen of claim 1, wherein the slurry flows outward from the shunt conduit via a nozzle connected to the shunt conduit.

8. A method of delivering a slurry into a wellbore about a well screen, the method comprising:

positioning slurry delivery shunt conduits circumferentially between multiple circumferentially spaced apart filter sections of the well screen, wherein the slurry delivery shunt conduits and filter sections are external to a swellable material that is external to a base pipe defining a longitudinal axis;

the filter sections and the slurry delivery shunt conduits radially outwardly displacing in a well as the swellable material then swells; and flowing the slurry through the shunt conduits.

9. The method of claim 8, wherein the outwardly displacing further comprises the swellable material swelling in response to contact with a fluid in the well.

10. The method of claim 8, wherein the outwardly displacing further comprises the shunt conduits outwardly displacing with the filter sections.

11. The method of claim 8, wherein the flowing further comprises flowing the slurry outward from the shunt conduits between the filter sections.

12. The method of claim 8, wherein the flowing further comprises flowing the slurry outward from the shunt conduits via nozzles connected to the shunt conduits.

13. A well system, comprising:

a base pipe configured for connection in a tubular string defining a longitudinal axis;

a swellable material overlying the base pipe;

multiple well screens, the well screens having filter sections, positioned in a wellbore external to the swellable material; and shunt conduits which deliver a slurry into the wellbore about the well screens, the shunt conduits being positioned external to the swellable material and circumferentially between the filter sections of the well screens prior to the swelling of the material.

14. The system of claim 13, wherein the filter sections are displaced outward in response to expansion of the well screens.

15. The system of claim 14, wherein the filter sections are displaced outward by the swellable material which swells in response to contact with a fluid in the wellbore.

16. The system of claim 13, wherein the well screens expand in response to contact between the swellable material and a fluid in the wellbore.

17. The system of claim 13, wherein the shunt conduit displaces outward in response to expansion of the well screen.

18. The system of claim 13, wherein the slurry flows outward from the shunt conduits between the filter sections.

19. The system of claim 13, wherein the slurry flows outward from the shunt conduits via nozzles connected to the shunt conduits.

* * * * *